US008430341B2

(12) United States Patent
Marcus

(10) Patent No.: US 8,430,341 B2
(45) Date of Patent: Apr. 30, 2013

(54) LONG DISTANCE GASSING APPARATUS AND METHODS

(75) Inventor: Frank S. Marcus, Lake in the Hill, IL (US)

(73) Assignee: OYSTAR North America LLC, Davenport, IA (US)

( * ) Notice: Subject to any disclaimer, the term of this patent is extended or adjusted under 35 U.S.C. 154(b) by 544 days.

(21) Appl. No.: 12/575,684

(22) Filed: Oct. 8, 2009

(65) Prior Publication Data

US 2010/0089455 A1 Apr. 15, 2010

Related U.S. Application Data

(60) Provisional application No. 61/195,642, filed on Oct. 9, 2008.

(51) Int. Cl.
*B05B 1/14* (2006.01)
*A62C 31/02* (2006.01)

(52) U.S. Cl.
USPC ..... 239/462; 141/92; 141/286; 239/396

(58) Field of Classification Search ..... 239/396, 239/462, 504; 141/11, 48, 63, 64, 69, 70, 141/85, 89, 91, 92, 285, 286; 53/245, 246, 53/510, 511
See application file for complete search history.

(56) References Cited

U.S. PATENT DOCUMENTS 5,911,249 A * 6/1999 Sanfilippo et al. ..... 141/64
2006/0231157 A1 * 10/2006 Marcus et al. ..... 141/85

* cited by examiner

*Primary Examiner* — Len Tran
*Assistant Examiner* — Justin Jonaitis
(74) *Attorney, Agent, or Firm* — Wood, Herron & Evans, LLP

(57) ABSTRACT

A gassing apparatus including a composite gas flow screen having a plurality of respective screen elements, each with at least one respective flow opening therein, the cross-sectional areas of the respective flow openings in respective elements decreasing in a downstream direction with respect to gas flow and at least one other screen element having no flow opening. A nozzle preferably produces a relatively high velocity central gas stream with surrounding gas streams of decreasing velocity as they are spaced further away from the central gas stream. Methods and apparatus are described.

10 Claims, 8 Drawing Sheets

LONG DISTANCE GASSING APPARATUS AND METHODS

PRIORITY CLAIM

Applicant claims priority of the filing date of U.S. provisional patent application Ser. No. 61/195,642 filed Oct. 9, 2008 entitled "LONG DISTANCE GASSING BUTTON", which application is expressly incorporated herein by reference.

FIELD OF THE INVENTION

This invention relates to the gassing of products and more particularly to the creation of a surrounding environment of gas about a product as part of a modified atmosphere packaging process or other treatment process.

BACKGROUND OF THE INVENTION

In the past, it has been known to surround a product, such as a food item for example, with a gas which is different in component or component proportions during a packaging or other process. This creates a preferred environment in which the food product resides within its package for such purposes as preservation, shelf life, freshness or other purposes.

Even more particularly, such treatment in the past has included flowing a gas, such as a gas containing a high nitrogen content, around a product or into a product container to at least partially separate the product from ambient atmosphere (which is ordinarily about 21% oxygen and 79% nitrogen, without limitation) and envelop in a modified atmosphere. In this manner, the container or package is then sealed, with the product thus encapsulated in a more preferred environment. Thus, ambient atmosphere is purged from the container or from around the product in favor of a more suitable gaseous environment.

In the past, such gassing is accomplished by flowing a desired gas onto or around a product or into a product container by means of rails, plates or other structures proximate the path of the products or the containers to which products are destined. Gas under pressure is presented to manifolds from where it flows through welded screens onto the product or into a container. One particular structure and process is described in U.S. Pat. No. 5,417,255, fully incorporated herein by reference. Another typical system is disclosed in U.S. Pat. No. 6,032,438, also fully incorporated herein by reference. Yet other prior systems also disclose gassing such as U.S. Pat. Nos. 5,816,024 and 7,412,811, also fully incorporated herein by reference. Yet other such systems are disclosed in United States Publication Nos. US2006/0231156 and US2006/0231157, likewise fully incorporated herein by reference. Such patents and publications are incorporated herein by this reference and made a part hereof as if fully set forth herein.

While these disclosures illustrate a variety of gassing systems, this present invention contemplates certain improvements relating to the gas flow itself. For example, it will be appreciated that the effective range and integrity of the gas flowing onto or toward the product or container is important, particularly when considering the potential interference of other processing or product handling or filling apparatus. For example, when the range of preferred gas flow of desired integrity is somewhat limited, the interference represented by these other structural features may make it impossible to generate the desired gas flow closely enough to the product or container to be sufficiently effective.

Accordingly, it is desired to provide a gas flow apparatus and methods having a greater range of preferred flow characteristics to enable desired gassing emanating from distances greater than heretofore attained.

It should be appreciated that while gas flow ranges may be theoretically affected or extended merely by increasing pressures or flow velocities, associated increasing turbulences may prevent the goal of increasing the desired range and may limit the effective range which otherwise may be theoretically attained. Even relative large variations in flow velocity between laminates of gas flow are detrimental to overall effective flow range as a result of boundary turbulence.

Accordingly, it is also desired to provide apparatus and methods for improving the parameters of gas flow characteristics emanating from a source so that increased effective range is attained without diminution of the integrity of the flow or gassing operations.

SUMMARY OF THE INVENTION

To these ends, a preferred embodiment of the invention contemplates an improved gassing flow generator creating a laminar gas flow having a higher velocity central flow stream with coaxial lamina flows decreasing in velocity as a function of distance from the central stream.

This is accomplished, in a preferred embodiment, by placing screen elements across a manifold, where the elements have coaxial openings decreasing in area in downstream direction, and where one element has no such opening. Gas is introduced to the manifold through a laminar input port for laminar flow creation through the elements, and a focused, higher velocity gas stream is directed through a nozzle directly onto one element having no centralized opening.

Such a structure creates a multi-laminar gas flow with a centralized higher velocity gas stream surrounded by a plurality of laminar flow "shells" or "sleeves" or "walls" of decreasing velocity as the laminar flow configurations are spaced further outwardly from the central, higher velocity flow.

The multiple laminar flow configuration can be circular, oblong or of any other configuration, but is preferably coaxial with the central higher velocity flow and other laminar flow sections.

Such embodiment enhances and extends the range over which the enveloping gas flow is effective and to an extent substantially in excess of the flow range of prior systems, even though using multiple screens but of different construction and screen orientation.

Moreover, the invention creates more uniform and extended range multiple laminar flows which enhances the integrity of the overall flow by eliminating debilitating effects of turbulence created by the flow or the multiple flow lamination of prior systems. In particular, the invention creates multiple flow laminations of differing velocities, spaced from the central flow, but without such relative velocity differences between each successive lamination as would produce debilitating turbulence at the boundary of any two adjacent laminations. This facilitates extension of the overall effective gassing range.

Even more particularly, a gassing apparatus according to the invention comprises a manifold body, four screen elements configured in parallel and adjacent to or part of the manifold. Three elements preferably have the same outside diameter but a different effective inside diameter opening (i.e. a centralized opening). One element has the same outside diameter but without a hole in the center. An accelerator nozzle is placed in the center of the manifold body for blowing outward in the direction of gas flow. The direction of gas flow is through the center of the four concentric elements. The manifold has two separate ports in which to individually control the gas flow rates. These include an offset laminar gas inlet port and a centrally disposed accelerator gas inlet port.

The nozzle discharges through a raised cone-shaped internal barrel. The cone shape serves to entrain the center jet with the internal laminar gasses within the manifold chamber creating a highly controlled flow pattern which travels a distance at least 3 times further than current gassing devices used for modified atmosphere packaging. The laminar port must be located significantly off center enough so as not to produce too much internal turbulence within the manifold body and should be placed away from the cone as far as possible.

The device is intended to blow outward and be aimed directly at the product to be gassed, typically used in Modified Atmosphere Packaging applications, hereby referred to as MAP applications, but can be used wherever a high purity stream of gas is required. This device, while preferably shrouded in any suitable way, or even when un-shrouded, can deliver a soft stream of gas at parts per million residual oxygen levels in the gas stream and in ranges up to three to five inches or more distance. At about three inches' distance, the stream of pure gas dissipates slightly but still maintains purity levels at distances at least 3 times greater than what is currently on the market for MAP applications. With shrouding the gassing range can be considerably increased with performance contingent upon the quality of shielding. The multi-element configuration of the four adjacent parallel elements, for example, is assembled so as to produce a quad-laminar flow of gas. Three elements have a hole or slot concentrically larger than the adjacent element. One element does not have a hole in it, and it this element that provides the backpressure within the manifold to establish the Quad-laminar or Penta-laminar accelerated flow pattern. The accelerator nozzle is placed to blow a stream of gas of about 0.040" in diameter through the center of the four stacked elements. This accelerator nozzle creates a low velocity high purity Penta laminar flow of gas. This soft high purity stream of gas can be controlled to travel at a slow enough rate so as to collect in the area where it is needed without spilling over due to too much gas flow.

An example of too much gas flow from previous MAP attempts would be if a blow off gun was used in lieu of this device. The blow off gun would create a high rate of flow thereby entraining oxygen into its path contaminating the stream and not allowing the product to collect the modified atmosphere gasses by pushing the gasses out with too much velocity. The preferred embodiment herein produces a highly controllable stream of gas with 4 or 5 separate layers of gas traveling at different rates, each internal stream or layer concentrically smaller protecting the jet of gas in the center. The manifold preferably has two separate gassing ports producing a ratio of laminar flow and accelerator nozzle flow. The invention can also be used without the accelerator nozzle, in which case a quad-laminar flow of high purity gas is produced, however this configuration creates a high purity stream of gas that travels 80%-90% the distance as compared to when the accelerator nozzle is being used.

In the preferred embodiment, each outward strata of gas flow produced during operation has approximately 50% slower flow velocity than each adjacent more inward strata of gas flow, and, in conjunction, each strata of gas has approximately (within 75%) the same "gas wall thickness". A good comparison for a ratio perspective of "gas wall thickness" would be a dart board or a shooting target with four or five concentric circles.

Operation wise; each exiting concentric gas strata moving outwards from the center will produce a slower stream of gas with the controllable jet of gas in the center providing additional penetration distance via the internal cone which sweeps and entrains the laminar gasses, under backpressure, into a controlled pattern which enables the device to project high purity, low velocity, gas streams.

Current designs such as dual-laminar flow gassing devices produce a high purity stream of gas that can only travel up to about ⅝ inches at best. Current Accelerator nozzle rails with dual laminar flow such as shown in Publication No. US2006/0231157 have up to ¾ inches of travel of high purity gas. The preferred embodiment herein can project a high purity stream of gas up to three inches in Quad-laminar mode and 3.5 inches in Penta-laminar mode or more, even up to five inches. Such embodiments are particularly useful where close proximity of a regular prior gassing rail is impossible. One of the reasons why prior dual laminar devices cannot project great distances is that the velocity ratio of the outer laminar stream to the high speed central stream is too high; thereby disrupting the flow by pulling back on the high speed center stream due to the Coanda Effect in conjunction with air resistance. The Coanda Effect, although primarily referred to in "gas to solid" embodiments, can also have an effect on adjacent gas streams in "gas on gas" situations. This device overcomes that dual lamination limitation by providing a gentler means of slow speed atmospheric gas delivery.

Accordingly, the invention achieves the advantage of extended range gassing with a flow of high integrity.

DETAILED DESCRIPTION OF THE INVENTION

Figure 5:
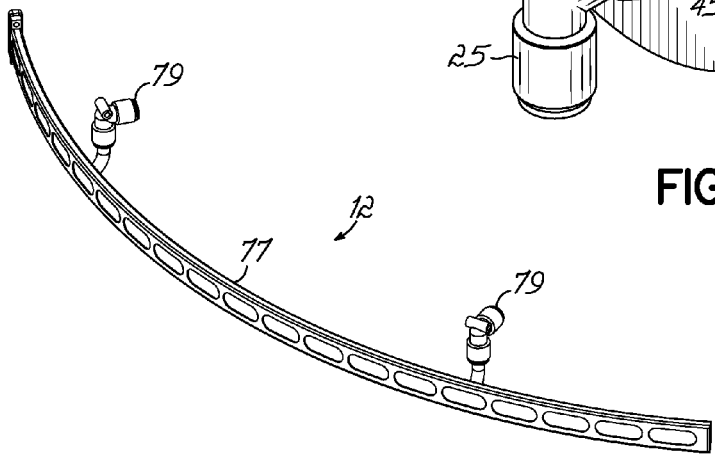
FIG. 5 is a perspective view of an alternate embodiment of the invention comprising a gassing rail according to the invention and showing the rail with several screen elements removed for illustrative purposes.
Figure 6:
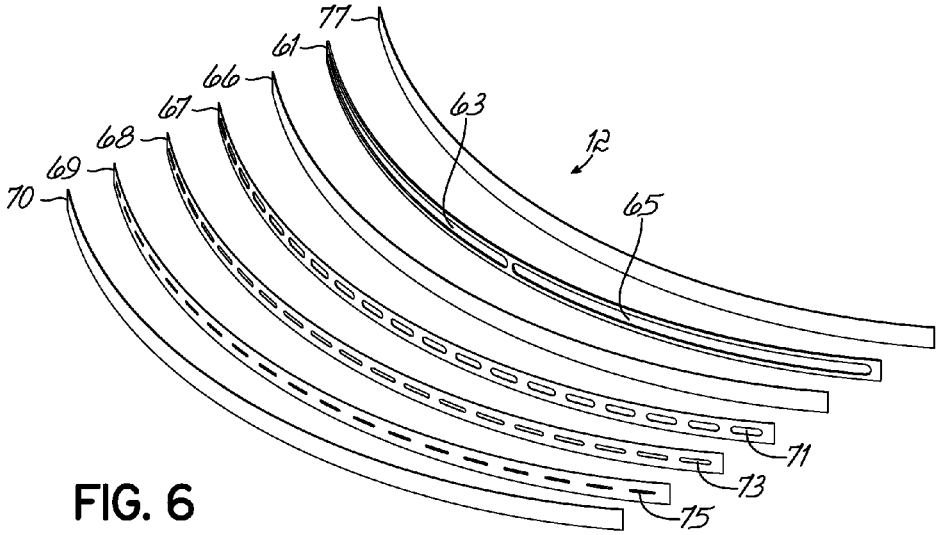
FIG. 6 is an exploded perspective view of the embodiment of FIG. 5 showing all screen elements.
Figure 7:
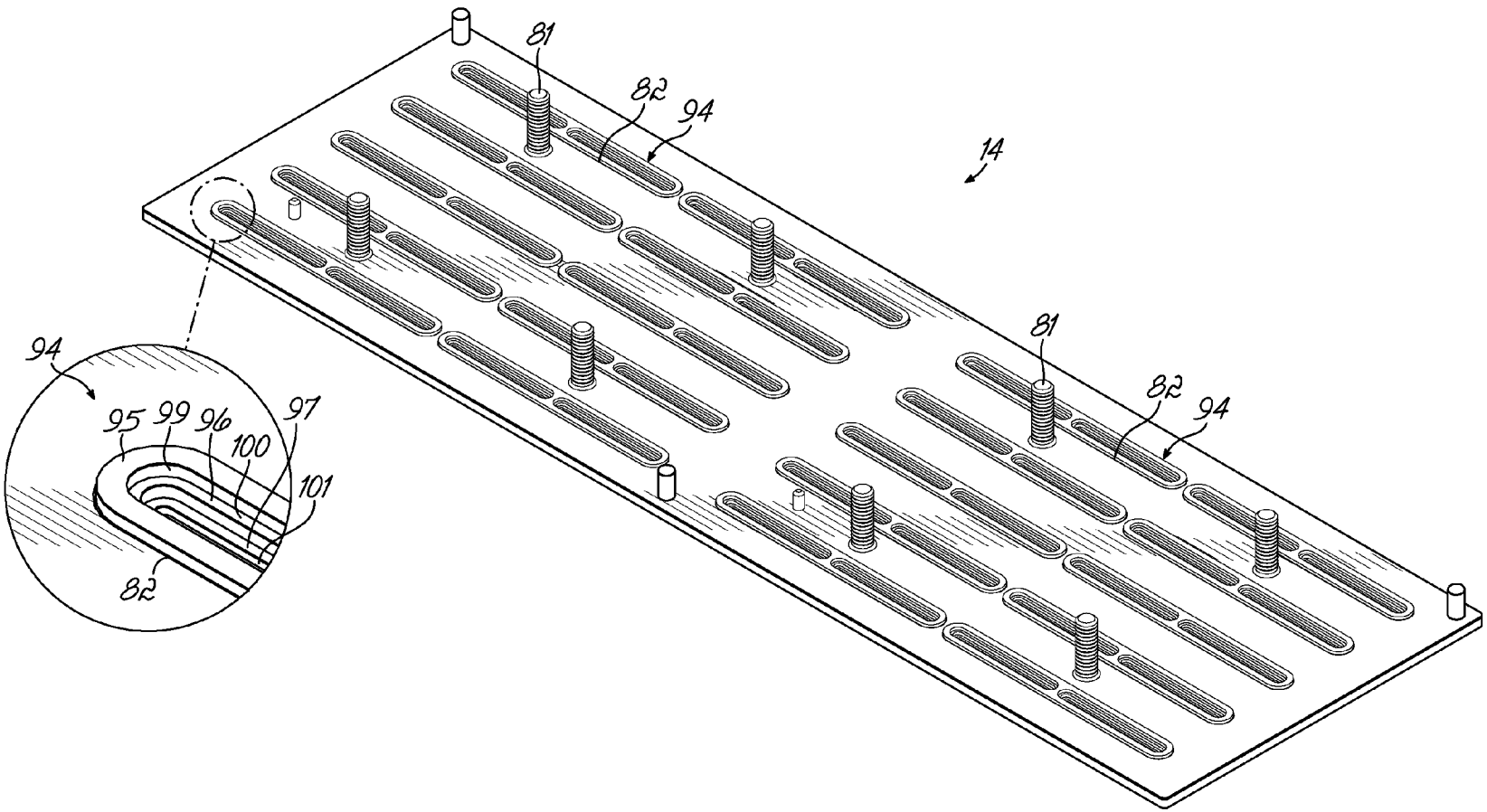
FIG. 7 is a perspective view of the rear side of a multiple port gassing plate according to the invention, with an enlarged detail of an encircled area.
Figure 8:
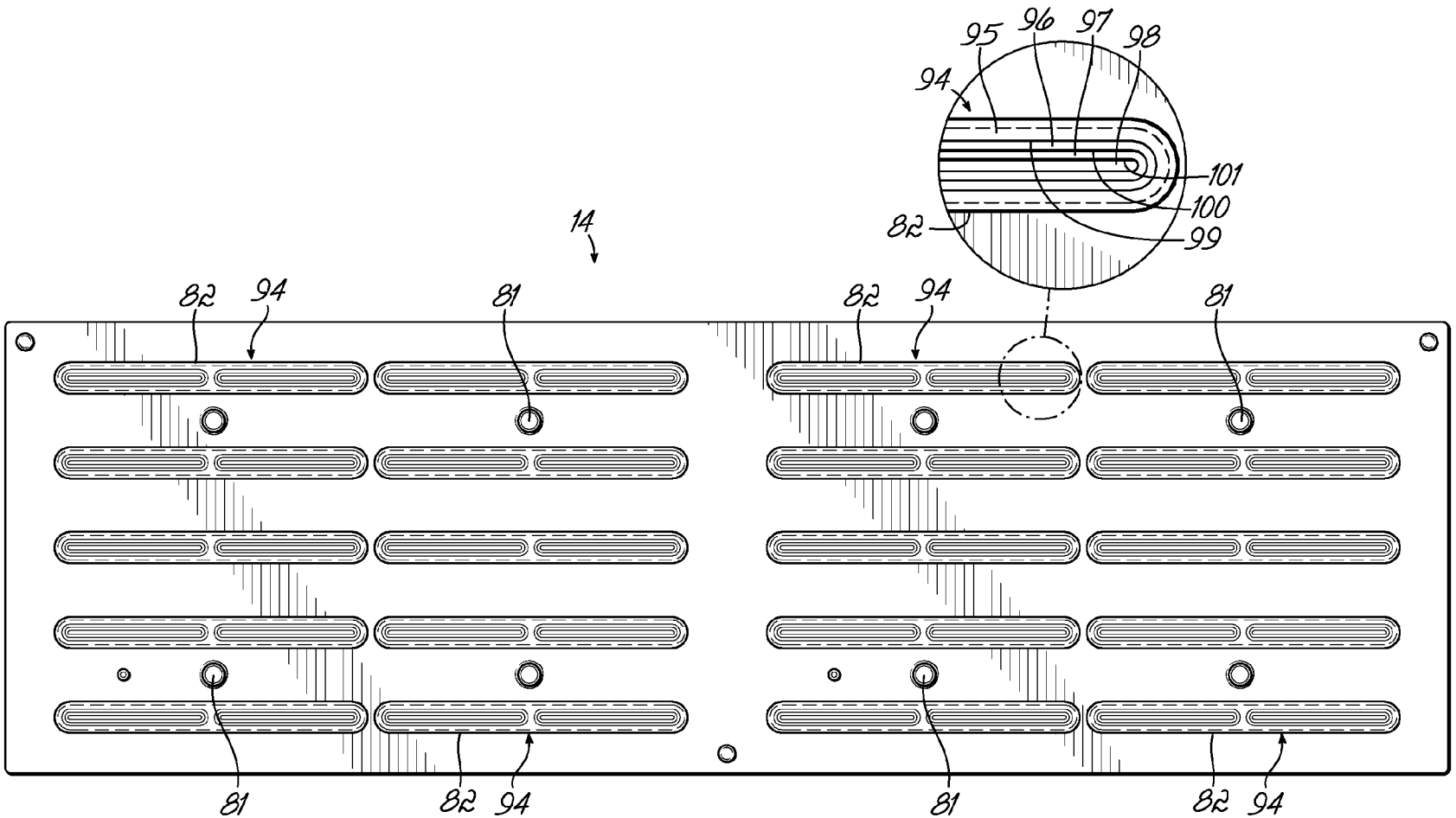
FIG. 8 is a rear plan view of the embodiment of FIG. 7, with an enlarged detail of an encircled area.
Figure 9:
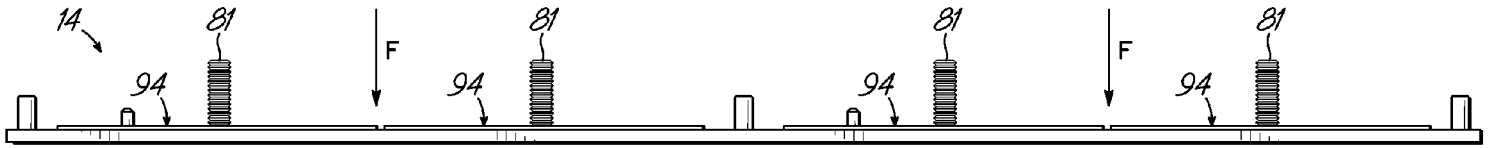
FIG. 9 is an elevational view of the embodiment of FIG. 8.
Figure 10:
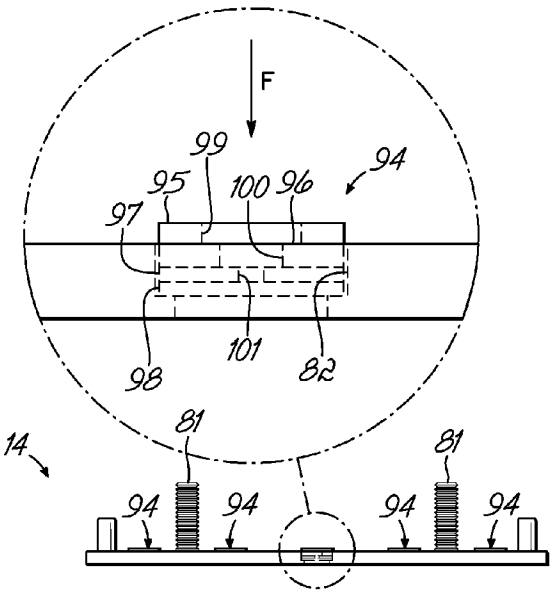
FIG. 10 is an end view of the embodiment of FIG. 8 with an enlarged detail of an encircled area.
Figure 11:
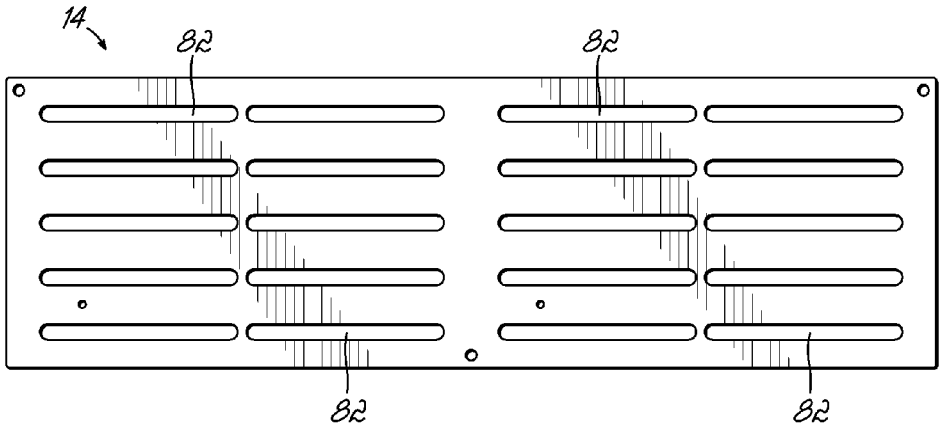
FIG. 11 is a view similar to FIG. 8 of a laser-cut gassing plate.
Figure 12:
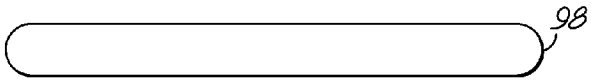
FIGS. 12-15 are respective plan views of the various screen elements of FIG. 11.
Figure 13:
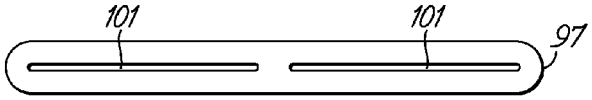
Figure 14:
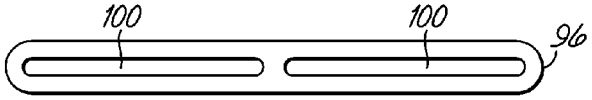
Figure 15:
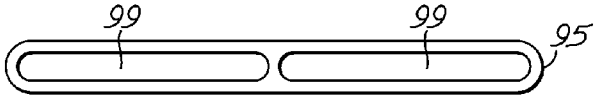
Figure 16:
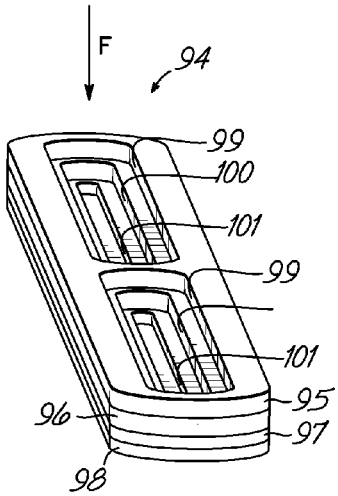
FIG. 16 is an isometric view of the assembled screen elements shown in FIGS. 12-15.

Turning to the drawings, there are shown several embodiments of the invention. A first embodiment comprises a gassing button 10 shown in FIGS. 1-4; a second embodiment comprises one form of gassing rail 12 as shown in FIGS. 5-6 and a third embodiment comprises a gassing plate 14, shown in FIGS. 7-17.

It will be appreciated that each embodiment includes a combination of screen elements according to the invention wherein each screen element preferably comprises a multiple layer composite of selected wire cloths. These cloths are, for example, constructed from layers of selected woven wire cloth, repeatedly calendared and diffusion bonded (or otherwise welded together) to form a single monolithic material capable of passing gas therethrough. For each element, a gas pressure drop across the element is created in part by the number of layers in the element. The more layers, the greater the pressure drop across the element.

Varied numbers of layers are preferably used in the respective composite screen elements described in the following embodiments. The two ply elements (or two layer) are preferably rated at 80 microns. The five ply or five layer element is rated at 75 microns. The four ply elements are rated at 50 microns.

Screen elements such as the five ply and two ply elements are available from various sources including the Purolator EFP Division of Clavcor, Inc., providing the screen elements under the mark "poropate". Purolator EFP is located at Shelby, N.C. and Clavco, Inc. at Franklin, Tenn. Such composite screen elements are further described for background at www.purolator efp.com/sinteredlam.htm#poroplate. The four ply screen element is available as part no. 704429 from the W.S. Tyler Company of St. Catharine's, Ontario, Mentor, Ohio and other locations. For background, see www.wstyler-.com. Other suitable screen elements and sources for them might be useful.

Figure 1:
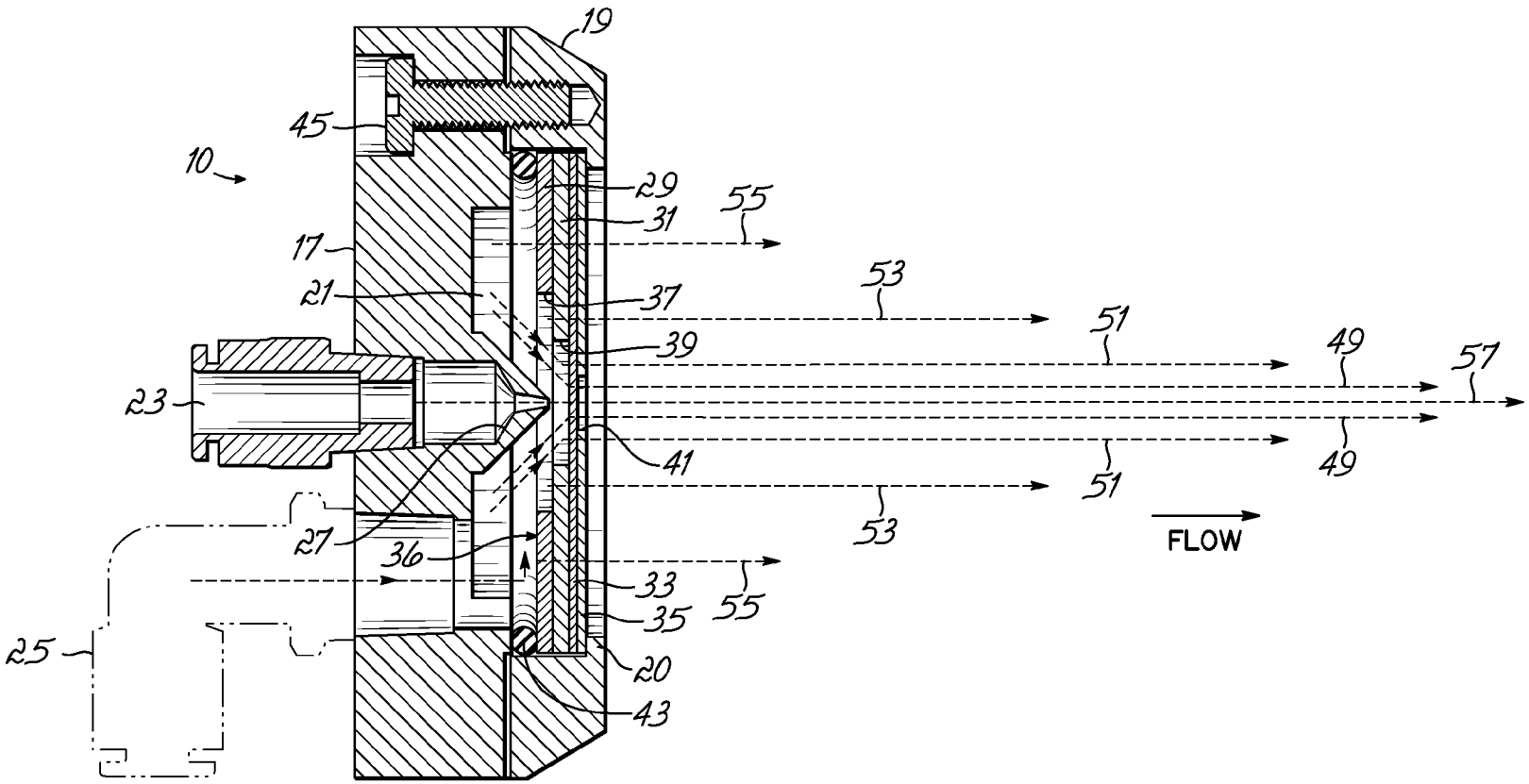
FIG. 1 is an elevational view in cross-section of a preferred embodiment of the invention.
Figure 2:
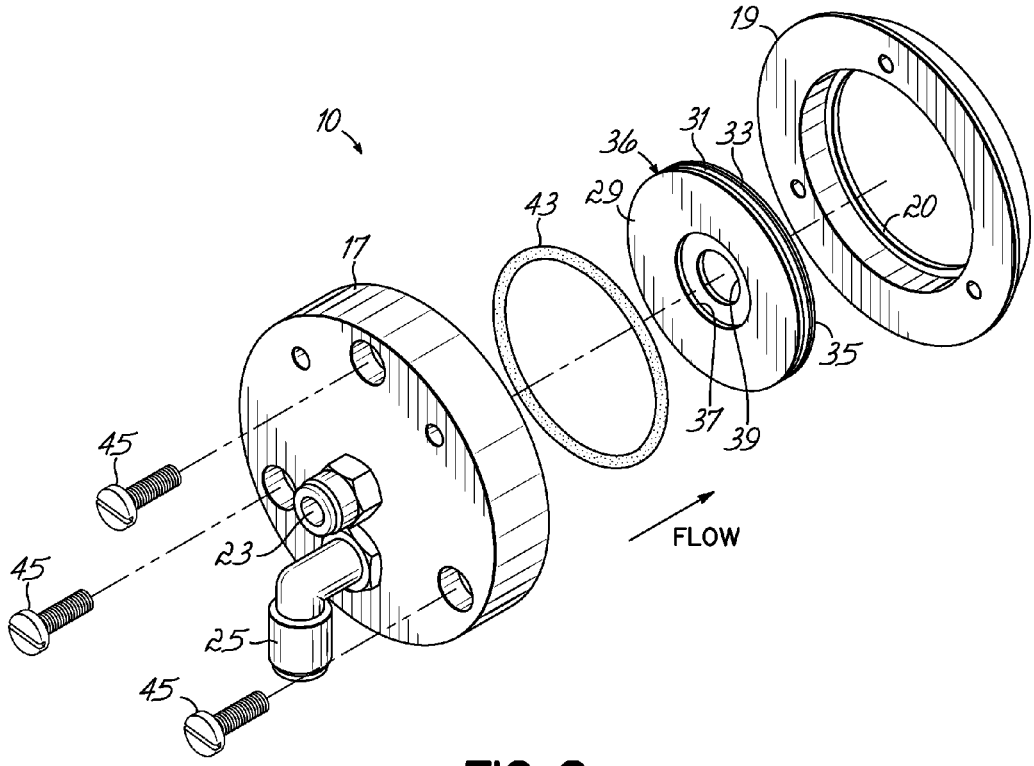
FIG. 2 is an exploded, forwardly directed perspective view of elements of the embodiment of FIG. 1.
Figure 3:
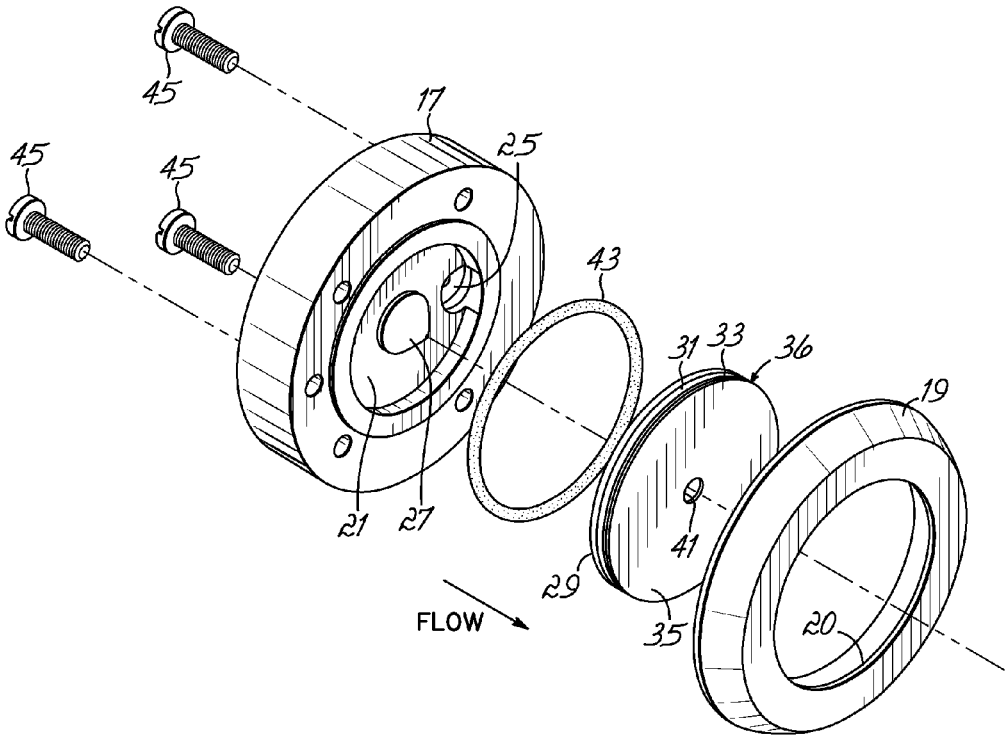
FIG. 3 is an exploded view similar to FIG. 2 but in a rearwardly directed view of the embodiment.
Figure 4:
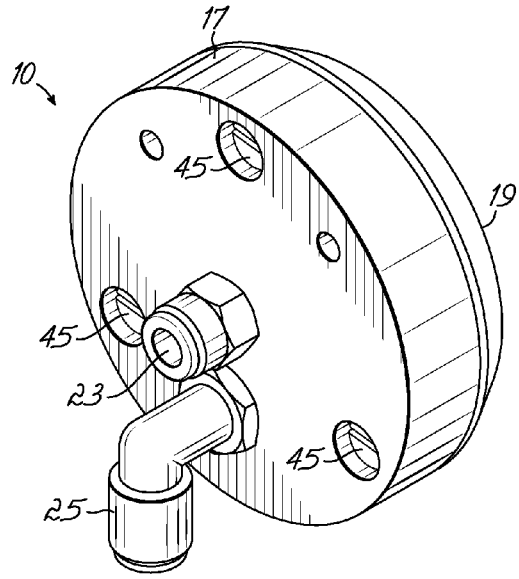
FIG. 4 is a perspective view of the invention of FIG. 1.

A first embodiment of FIGS. 1-4 includes gassing button 10, comprising a body 17, a face bezel 19, a manifold area 21, an accelerator inlet port 23, a laminar inlet port 25, a cone-shaped nozzle 27 and a plurality of screen elements 29, 31, 33 and 35 forming a composite screen 36. As indicated, elements 29 and 31 are five ply elements and elements 33 and 35 are preferably two ply elements. Element 33 is preferably uniform, with no central opening, whereas elements 29, 31 and 35 have central openings therein, respectively at 37, 39 and 41, as shown in FIG. 1. These openings are preferably coaxial and decrease respectively in diameter or in cross-sectional area in a downstream direction with respect to the flow of gas therethrough.

Each element typically has a downstream or fine side or ply as opposed to an upstream coarser side or ply with respect to the flow of gas therethrough.

An O-ring gasket 43 seals the rear of screen 36 to body 17, while fasteners 45 (shown) draw bezel 19 rearwardly to capture screen 36 and urge it rearwardly by virtue of shoulder 20.

When gas is applied through laminar port 25 to manifold 21, pressure is created to flow gas through screen 36. Gas exits the screen in a plurality of cylindrically-shaped or sleeve-like coaxial laminations, strata or flow paths 49, 51, 53, 55 (FIG. 1). The velocity of each inner strata or flowing gas in a path is slightly less than that velocity of an inwardly positioned flow path, about 50% or so less. Thus, each outward strata flows more slowly than the adjacent inward strata. The wall thickness of each strata or flow or path is preferably within about 75% of the same thickness of other flow strata. Other relationships of velocity and wall thickness might be used.

When gas is applied through accelerator port 23, it flows through nozzle 27, impinges on element 33 where there is no central opening, and exits through opening 41 in element 35 in a relatively higher velocity flow path 57 (FIG. 1). The velocity of gas in strata or path 49, surrounding flow path 57, is less than that of path 57, while the velocity of flow strata 51 is less than that of path 49, and so on, outwardly.

It will be appreciated that introduction of pressurized gas in port 23 in conjunction with gas pressure through port 25 creates a Penta-lamina gas flow in paths 49, 51, 53, 55 and 57. When no gas is introduced at accelerator port 23, a quad-laminar flow is produced by button 10 in paths or strata 49, 51, 53 and 55 (not in 57). The Penta-flow operation has a longer effective range than the quad-flow pattern, where no central flow 57 is generated. These flow patterns are produced in differential velocities as a function of outer strata flow, passing through more screen elements than more inner strata flow. In other word, the pressure drop across the screen is more pronounced, the further it is measured from the center axis of the screen.

In use, such a button is oriented in the vicinity of a product to be packaged, or of a container, and directs the gas flows described above onto the product or into the container to purge atmosphere from around the product or in the container, whereupon the product is sealed in a preferred environment, such as nitrogen, for example, displacing oxygen typically present in a non-gassed surrounding.

The direction of gas flow can be directed horizontally, vertically or at other angles onto the product or container. It will also be appreciated that button 10 as described produces an overall gas stream of cylindrical shape with laminar co-axial gaseous walls of decreasing velocity as the stream layers progress outwardly of the axis.

Such apparatus produces efficient gas environments of high integrity up to ranges of five inches or more, and are particularly useful where other processing equipment such as fillers, sealers, transfers or the like prevent closer positioning of the gas flow apparatus.

These general configuration concepts are useful in the further embodiments described herein where apparatus and flow paths change in shape but embody the same flow concepts producing an extended effective gassing range.

Turning to an alternate embodiment of FIGS. 5 and 6, a gassing rail 12 according to the invention is described. Gassing rail 12 includes a manifold frame or element 61 defining manifold chambers such as at 63, 65, and a solid baffle plate or four ply element 66 for spreading out gas uniformly. Screen elements 67-70 are illustrated in FIG. 6. Element 70 is a solid, two ply screen element, while elements 67-69 each have elongated, aligned slots. Element 67 is preferably of five ply construction, with slots 71. Element 68 is preferably of four ply construction with slots 73 and element 69 is preferably with slots 75. Respective slots 71, 73, 75 are respectively indexed with each other as shown.

Slots 71, 73, 75, respectively, decrease in cross-sectional area in a downstream direction as seen in FIG. 6.

Rail 12 is provided with a back plate 77, closing off and defining the manifold chambers 63, 65 etc. Chambers 63, 65, etc. operationally pressurize one or more openings in the respective elements 67-69.

As shown in FIG. 5, gas ports 79 are provided to pressurize manifolds 63, 65, etc. so that gas passes through elements 66-70 and flows outwardly at an extended range in a quad-flow orientation from each series of ports and with flow velocities from each series of ports diminishing in each strata of flow measured from the center of the elements.

Rail 12 is curved. Thus, a rail can be oriented proximate a curved product path or container path to effectively purge atmosphere with a more uniform and desirable gas environment, and from an extended position up to five inches or more removed from a product or container. This accommodates other handling or processing structures otherwise interfering with gassing devices limited to shorter effective ranges, and thus requiring closer placement to the gassing device.

Figure 17:
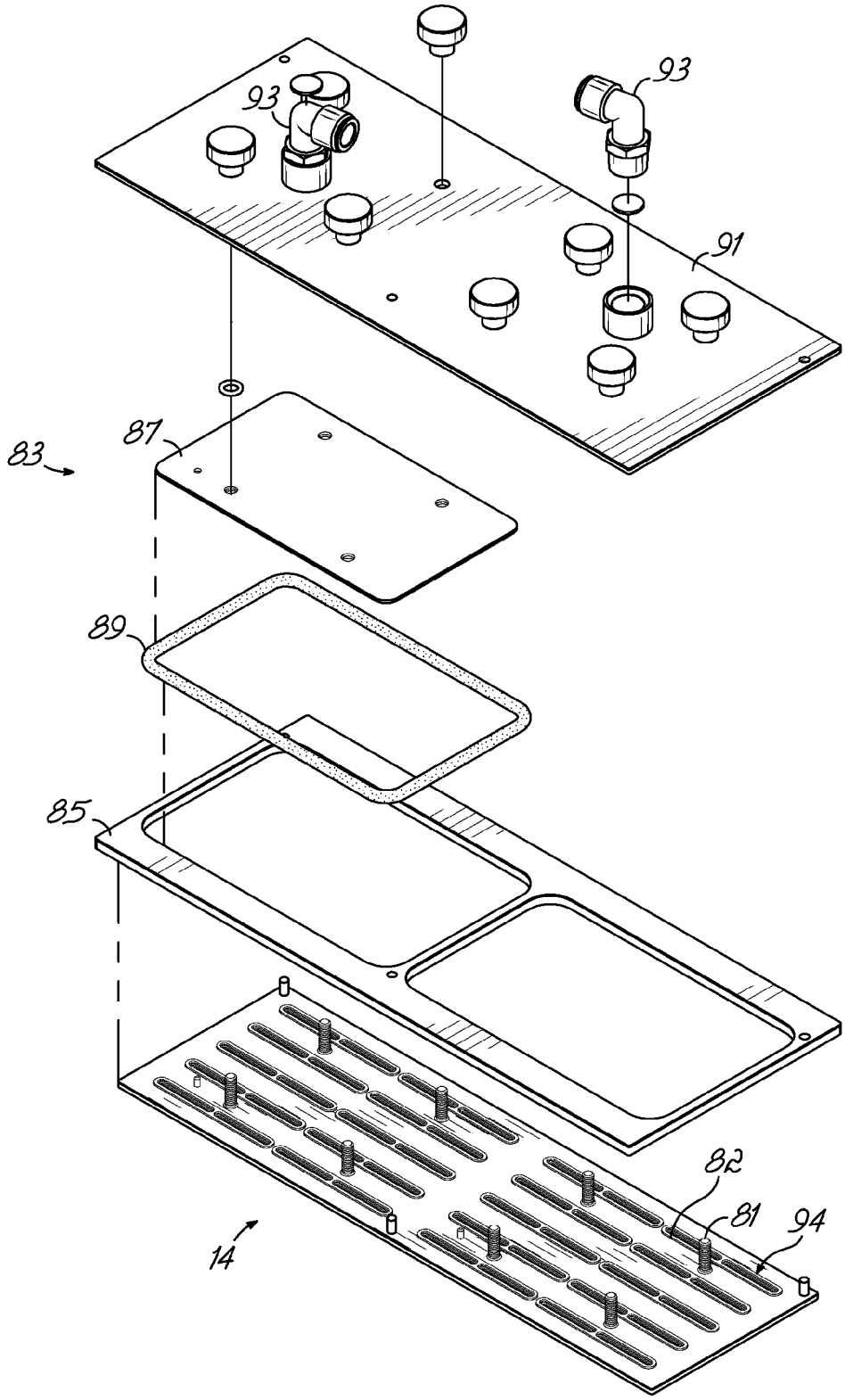
FIG. 17 is an exploded view of the components of a gassing plate shown in FIGS. 7-16.

FIGS. 7-17 illustrate in further view an embodiment according to the invention comprising gassing plate 14. In this embodiment, gas outlets 82 are defined in closely spaced relation in the plate 14. Such plate can be operationally mounted by means of fixtures or fasteners 81 to an appropriate manifold 83 defined by frame 85, baffle elements 87 (only one of which is shown in FIG. 17), gasket 89 and port plate 91 having gas inlet ports 93.

As shown in the FIGS., a screen 94 (FIG. 16) comprises a composite of a plurality of elements 95-98 such as described above. Elements 95, 96 are preferably four ply while elements 97, 98 are preferably two ply. Elements 95-97 are provided with oval or other shaped slots 99-101 respectively, while element 98 has no such opening.

Slots 99-101 decrease in cross-sectional area respectively progressively in a downstream direction relative to flow path F as noted in the FIGS.

When pressurized gas is applied to screen 94, it passes therethrough, resulting in the quad-laminar flow of stratas as described above, producing an extended effective gassing range of five inches or more with the same spatial functions and advantages such as noted above and when oriented proximate a product or container.

Accordingly, in structures according to the invention where gas is flowed through elements having one or more openings decreasing in area, and one or more elements with no such openings, multi-lamina effective gas flows are produced in here-to-fore unattainable flow ranges, facilitating effective gassing in cramped systems with a high integrity of gas flow.

In any of the embodiments, shrouding can be provided to further protect and project the integrity and range of gas flow.

It will be appreciated that a different number of screen elements or varied composites thereof may be used to produce preferred quad-laminar or Penta-lamina extended range flows.

These and other objects and advantages will be readily apparent to one of ordinary skilled in the art without departing from the scope of the invention and applicants intend to be bound only by the claims which are made in this application.

What is claimed is:

1. Gassing apparatus including:

a composite gas flow screen having a center axis and having a plurality of respective gas flowing screen elements, each with at least one respective unscreened centrally disposed flow aperture therein, the cross-sectional areas of the respective unscreened centrally disposed flow apertures in respective elements decreasing in a downstream direction with respect to gas flow; and at least one other gas flowing screen element having no unscreened centrally disposed flow aperture, interposed between two of said screen elements of said plurality of screen elements.

2. Apparatus as in claim 1 wherein said screen and said openings are oblong.

3. Apparatus as in claim 1 wherein said screen elements flow multi-laminar coaxial streams of gas therefrom with each stream of lesser velocity than a stream interior thereof; when gas pressure is applied to said common manifold.

4. Apparatus as in claim 1 comprising a circular gassing button having a body and a screen retaining face bezel operably connected to said body, said screens disposed in said bezel.

5. Apparatus as in claim 1 comprising a gassing rail.

6. Apparatus as in claim 1 comprising a gassing plate.

7. Gassing apparatus including:

a gas manifold;

a composite gas flow screen having a center axis, said composite gas flow screen having a plurality of respective gas flowing screen elements, each with at least one respective unscreened flow aperture therein centrally disposed about said axis, the cross-sectional areas of the respective unscreened centrally disposed flow apertures in respective elements decreasing in a downstream direction with respect to gas flow;

said gas manifold operably common to each of said screen elements; and at least one other gas flowing screen element having no unscreened centrally disposed flow aperture;

wherein each said screen element is at least partially in direct fluid communication with said common manifold; and at least one further screen downstream of said at least one other screen with no aperture, said one further screen having an unscreened centrally disposed flow aperture therein;

said screens defining a plurality of annular co-axial gas flow patterns about a central gas flow path for gas passage when said gas manifold is pressurized with gas.

8. Apparatus as in claim 7 wherein said co-axial gas flow patterns comprise at least four independent annular gas patterns, each annular pattern having a wall thickness within about 75% of a next adjacent interior annular gas pattern.

9. apparatus as in claim 8 wherein said annular gas patterns are defined in said apparatus about an axial flow path along said axis.

10. Apparatus as in claim 7 wherein said screen elements and said openings are circular, and further including:

an accelerator nozzle centrally oriented with respect to said manifold for directing a relative high velocity stream of gas toward a center axis of said composite screen.

* * * * *